United States Patent [19]

Siniuk

[11] 4,413,421

[45] Nov. 8, 1983

[54] PICTURE HANGING LOCATOR

[76] Inventor: Nickolay Siniuk, 235 Genevieve, Windsor, Ontario, Canada

[21] Appl. No.: 368,730

[22] Filed: Apr. 15, 1982

[51] Int. Cl.[3] ..... G01B 3/02

[52] U.S. Cl. ..... 33/180 R

[58] Field of Search ..... 33/180 R; 40/617; 78/367; 246/466

[56] References Cited

U.S. PATENT DOCUMENTS

| | | | |
|---|---|---|---|
| 3,126,575 | 3/1964 | Schoeneberg | 40/617 |
| 3,310,899 | 3/1967 | Hart et al. | 40/617 |
| 3,516,165 | 6/1970 | Peeffer | 33/180 R |
| 3,530,591 | 9/1970 | Moffitt | 33/180 R |
| 3,564,759 | 2/1971 | Buttermore | 40/617 |
| 4,220,309 | 9/1980 | Eisen et al. | 33/180 R |
| 4,244,127 | 1/1981 | Buzzard | 40/617 |
| 4,382,337 | 5/1983 | Bendick | 33/180 R |

FOREIGN PATENT DOCUMENTS

| | | | |
|---|---|---|---|
| 395357 | 2/1909 | France | D8/367 |

*Primary Examiner*—Willis Little

*Attorney, Agent, or Firm*—Chas. Krassov

[57] ABSTRACT

This invention is a device for marking the location upon a wall where a framed picture is to be hung. It consists of a rubber or plastic coated wire, the upper end of which is wound into a short coil, by means of which it is held by inserting a finger therein. A downward straight shank extending from said coil; and said shank terminating into a hook upon which is hung the frame of a framed picture, during the locating of the said picture upon the wall.

2 Claims, 5 Drawing Figures

PICTURE HANGING LOCATOR

This invention consists of a device by means of which various types of framed pictures or documents can be located and hung upon a wall, rapidly and in the exact location.

Many people experience considerable difficulty in the hanging of a picture upon a wall. The framed picture is usually hung in the wrong location, several times, before the person who is hanging the picture, is completely satisfied with its final location upon the wall, or its relation to the other pictures already hanging on the wall.

In many cases a measuring tape is used a great deal to determine the location of a picture upon a wall, in which case much time is lost in the performance of a simple operation.

Also, the practice of hanging and rehanging of the same picture several times, and each time relocating the nails or hangers, causes much damage to the walls.

Therefore, the primary object of this invention, is to simplify the locating and hanging of a framed picture, and to reduce the time consumed in doing so.

This is accomplished in the invention by providing a simple but efficient picture hanging locator, by means of which the exact required location where the picture should be hung can be determined instantly and with little effort.

Figure 2:
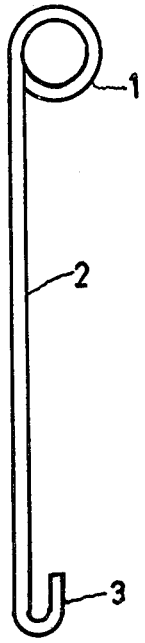
Figure 1:
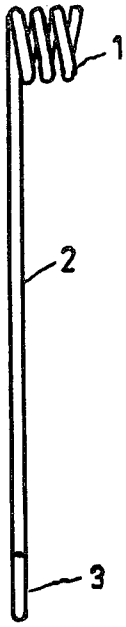
Figure 4:
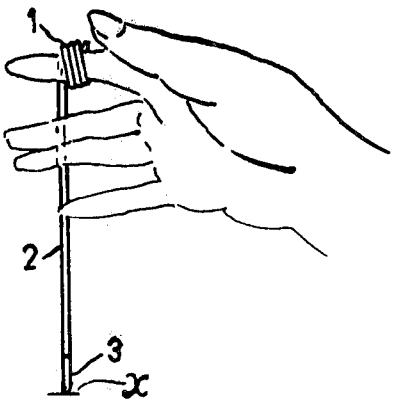
Figure 3:
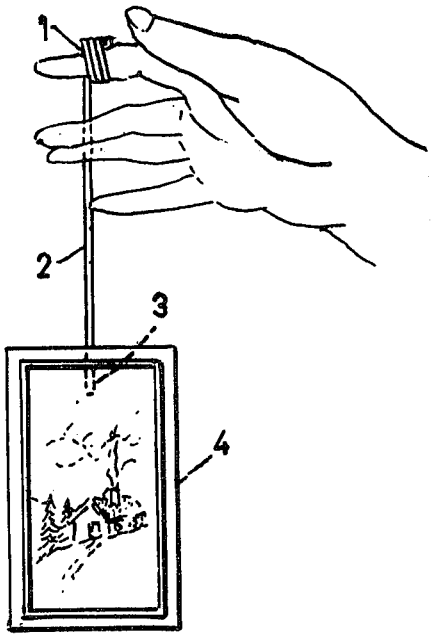
Figure 5:
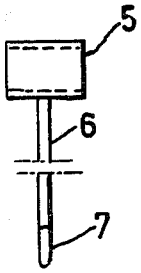

In describing the invention, reference will be made to the attached drawings in which, FIG. 1 shows a front view of the invention, FIG. 2 shows a side view of the invention, FIG. 3 shows the first step in the use of the invention, FIG. 4 shows the next step in the use of the invention, and FIG. 5 shows a variation in the construction of the invention.

The invention, as shown in FIGS. 1 and 2, consists of a rubber or plastic covered wire which is formed into a coil 1 having an inside diameter large enough to accommodate therein the index finger of the hand, as shown in FIG. 3. The wire continues downwardly in a straight shank 2, and terminates at the end of the shank 2 into a short upwardly bent hook 3.

The manner into which the locator is used in the process of hanging a framed picture consists of hanging the picture 4 from the hook 3 by attaching said hook to about the center and rear of the upper part of the picture frame, inserting the index finger into the coil 1, with the shank 2 behind the hand and against the wall, and moving the hand in any direction, until the picture is in the required location. With the hand remaining in the final position, the picture is removed, and a mark is made upon the wall, at the bottom of the hook 3, as shown at "X" in FIG. 4. The nail, or whatever the wall attachment may be, is inserted into the wall, and the picture is hung thereon.

Instead of using rubber coated wire in the construction of the invention, it can be moulded out of a plastic material, having the appearance as shown in FIG. 5, whereby coil 1 is replaced by a short tube 5 to which is attached a shank 6, having a hook 7 on its end for the attachment to the picture frame, as described above.

Experimentation with the invention, both in the home and in economical establishments, has proven to be a great time and labor saver, and a good protection against unnecessary damage to wall surfaces.

Having described my invention, what I claim is:

1. A device for locating the hanging location of a frame picture upon a wall, comprising: of a rubber or plastic covered wire which is wound at its top into a short coil having an inside diameter to permit the insertion therein of an index finger and by means of which said device is held against the wall; the wire of said coil continuing downwardly and transversely to the longitudinal axis of said coil into a straight shank which abuts the wall when the device is held against it; the free end of said shank terminating in a hook, upon which the frame of said picture is freely suspended, so that after locating where the picture should be permanently hung, the picture is removed, exposing the hook, the bottom of which is marked upon the wall as the spot where the nail or hanger is attached to the wall.

2. A device according to claim 1 characterized by said shank extending tangentially from one side of said coil and said hook extending outwardly from said shank in the same direction as said coil.

* * * * *